US007490118B1

(12) United States Patent
Kovach, II et al.

(10) Patent No.: US 7,490,118 B1
(45) Date of Patent: Feb. 10, 2009

(54) EXPANDING INSTRUCTION SET USING ALTERNATE ERROR BYTE

(75) Inventors: Louis G. Kovach, II, Belleville, MI (US); Neil Percibal Young, Redwood City, CA (US)

(73) Assignee: Liontech Trains LLC, Chesterfield, MI (US)

( * ) Notice: Subject to any disclaimer, the term of this patent is extended or adjusted under 35 U.S.C. 154(b) by 1168 days.

(21) Appl. No.: 10/705,216

(22) Filed: Nov. 7, 2003

(51) Int. Cl.
*G06F 15/00* (2006.01)
*B61L 3/00* (2006.01)

(52) U.S. Cl. ..... 708/200; 712/210; 246/167 R

(58) Field of Classification Search ..... 708/200; 712/210, 213; 246/167 R
See application file for complete search history.

(56) References Cited

U.S. PATENT DOCUMENTS 5,638,522 A 6/1997 Dunsmuir et al.
5,749,547 A 5/1998 Young et al.
6,019,289 A 2/2000 Sung
6,220,552 B1 4/2001 Ireland
6,275,739 B1 8/2001 Ireland
6,281,606 B1 8/2001 Westlake
6,318,678 B2 11/2001 Ireland
6,367,742 B1 4/2002 Ireland
6,441,570 B1 8/2002 Grubba et al.
6,457,681 B1 10/2002 Wolf et al.
6,485,347 B1 11/2002 Grubba et al.
6,491,263 B1 12/2002 Sung et al.
6,513,763 B1 2/2003 Ireland
6,533,223 B1 3/2003 Ireland
6,533,224 B1 3/2003 Ireland
6,536,716 B1 3/2003 Ireland et al.
6,539,292 B1 3/2003 Ames
6,545,886 B1 4/2003 Ireland
6,550,000 B1 * 4/2003 Minematsu et al. ..... 712/215
6,604,641 B2 8/2003 Wolf et al.
6,619,594 B2 9/2003 Wolf et al.
6,624,537 B2 9/2003 Westlake
6,655,640 B2 12/2003 Wolf et al.
6,662,917 B1 12/2003 Wolf et al.
6,729,584 B2 5/2004 Ireland
6,745,319 B1 * 6/2004 Balmer et al. ..... 712/223
6,747,579 B1 6/2004 Ireland (Continued)

OTHER PUBLICATIONS

"Astrac lets you control 5 trains on one track, in different directions, at different speeds-simultaneously," product advertisement from General Electric Corporation in Model Railroader magazine (Nov. 1963).

(Continued)

*Primary Examiner*—Chuong D Ngo
(74) *Attorney, Agent, or Firm*—O'Melveny & Myers LLP

(57) ABSTRACT

Expanding the capacity of a fixed digital field using a unique number calculated from the digital field, such as an error code. Expansion is possible by calculating a new error code using a different algorithm. A recipient, upon not detecting the error code from the original algorithm, checks for the new error code before indicating an error. The presence of the new error code acts like an extra bit to give an entirely new set of numbers for the digital field, thus doubling the command set. In another aspect of the invention, fill bits between transmission packets are used to indicate further data, and are included in calculating the new error code.

17 Claims, 3 Drawing Sheets

U.S. PATENT DOCUMENTS

| | | | |
|---|---|---|---|
| 6,765,356 | B1 | 7/2004 | Denen et al. |
| 2001/0005001 | A1 | 6/2001 | Ireland |
| 2003/0015626 | A1 | 1/2003 | Wolf et al. |
| 2003/0127570 | A1 | 7/2003 | Ireland |
| 2003/0142796 | A1 | 7/2003 | Ames |
| 2004/0079841 | A1 | 4/2004 | Wolf et al. |
| 2004/0239268 | A1 | 12/2004 | Grubba et al. |
| 2005/0023416 | A1 | 2/2005 | Wolf et al. |

OTHER PUBLICATIONS

"DCC (Digital Command Control) Standards & Recommended Practices," National Model Railroad Association, Inc. (Mar. 1997-Jul. 2004).
Gutierrez "Introducing the CTC-16: A 16-channel command control system you can build Part 1," Model Railroader pp. 64-67 (Dec. 1997).
Gutierrez "The CTC-16: A 16-channel command control system you can build Part 2," Model Railroader pp. 86-93 (Jan. 1980).
Gutierrez "The CTC-16: A 16-channel command control system you can build Part 3," Model Railroader pp. 89-92 (Feb. 1980).
Gutierrez "The CTC-16: A 16-channel command control system you can build Part 4," Model Railroader pp. 89-93 (Mar. 1980).
Gutierrez "The CTC-16: A 16-channel command control system you can build Part 5," Model Railroader pp. 71-77 (Apr. 1980).
Gutierrez et al. "The CTC-16: epilogue," Model Railroader pp. 132-136 (Dec. 1980).
Gutierrez "Build the wireless throttle 1," Model Railroader pp. 86-95 (Mar. 1983).
Gutierrez "Build the wireless throttle 2," Model Railroader pp. 68-75 (Apr. 1983).
"Infrared Control Unit," Model Railroader pp. 54-56 (Mar. 1991).
Pussel μP-programmable speed controller for model railways, Elektor (Jul./Aug. 1979).
Sperandeo "Commercial Command Control Systems," Model Railroader pp. 80-81 (Nov. 1979).
Westcott "Is Astrac on the right track?" Model Railroader pp. 33-37 (Dec. 1963).
Wigmore "The Digital Model Train Part 1 ," Elektor Electronics pp. 42+46 (Feb. 1989).
Wigmore "The Digital Model Train Part 2 ," Elektor Electronics pp. 50-53 (Mar. 1989).
Wigmore "The Digital Model Train Part 3 ," Elektor Electronics pp. 14-18 (Apr. 1989).
Wigmore "The Digital Model Train Part 4 ," Elektor Electronics pp. 16-17 (May 1989).
Wigmore "The Digital Model Train Part 5 ," Elektor Electronics pp. 56-59 (Jul./Aug. 1989).
Wigmore "The Digital Model Train Part 6 ," Elektor Electronics pp. 44-47 (Sep. 1989).
Wigmore "The Digital Model Train Part 7 ," Elektor Electronics pp. 21-24 (Oct. 1989).
Wigmore "The Digital Model Train Part 8 ," Elektor Electronics pp. 32-36 (Nov. 1989).
Wigmore "The Digital Model Train Part 9—Keyboards ," Elektor Electronics pp. 24-28 (Dec. 1989).
Wigmore "The Digital Model Train Part 10—RS232 Interface," Elektor Electronics pp. 38-43 (Jan. 1990).
Wigmore "The Digital Model Train Part 11—The Monotor Unit," Elektor Electronics pp. 53-55 (Feb. 1990).
Wigmore "The Digital Model Train Part 12—Address Display," Elektor Electronics pp. 52-54 (Mar. 1990).
Wigmore "The Digital Model Train Concluding Part," Elektor Electronics pp. 24-26 (Apr. 1990).

* cited by examiner

EXPANDING INSTRUCTION SET USING ALTERNATE ERROR BYTE

BACKGROUND OF THE INVENTION

The present invention relates to data protocols, and in particular command protocols for model trains.

A variety of control systems are used to control model trains. In one system, the power to the track is increased, or decreased, to control the speed and direction of the train. Multiple trains can be controlled by providing different power levels to the different sections of the track having different trains (see, e.g., U.S. Pat. No. 5,638,522). In another system, a coded signal is sent along the track, and addressed to the desired train, giving it a speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,749,547 and 5,638,522 issued to Neil Young et al. show such a system. The instructions, or commands, have a particular format for a particular model train manufacturer. Trains already in customer's hands are designed to respond to only that format, limiting the options for future expansion.

The current Lionel Trainmaster command format uses 23 bits to assemble a command. These bits are grouped together as 4 bit nibbles (a nibble is half of an 8 bit byte) and are represented in hexadecimal (hex). The first four nibbles translate directly to the Train Master command set, instructing the train on speed, use of horns, smoke, lights, etc. The fifth nibble is a unique number used to detect errors, an error code. The error code represents the addition of the first four nibbles without a carry. The following is and example of a Train Master Engine 1 horn command.

Old Method

| | | | | | | |
|---|---|---|---|---|---|---|
| 0000 | 0000 | 1001 | 1100 | 0101 | 111 | |
| 0 | 0 | 9 | C | 5 | Trailer (always ones) | Engine 1 Horn |
| \| | command | | | \| error \| | | |

The error check nibble is calculated by adding 0+0+9+C=15Hex. The upper digit 1 is dropped and the error check nibble becomes 5. The receiver then recovers the first 4 nibbles directly and converts them into Trainmaster Commands. The receiver then looks for a 5 and only a 5 in the fifth nibble position. If a 5 is received the transmission is considered good and is allowed to pass. If a nibble other than 5 is received the message is rejected. The three trailer bits at the end of the message are not used by current receivers for data information. Two bits are used to fill the time until the next command packet, and a third bit is set to offset any DC bias imparted by the combination of bits in the command, as discussed in more detail below.

All of the commands in the current command structure have been used, to both designate a variety of commands and address different trains or other controlled devices on a train set. No new commands are possible, but it would be desirable to add new commands for additional features, and to have the system backward compatible with existing model trains.

BRIEF SUMMARY OF THE INVENTION

The present invention provides a method and apparatus for expanding the capacity of a fixed digital field. The invention uses a unique number calculated from the digital field, such as an error code. An error code or other unique number is calculated using a particular algorithm, such as an addition or exclusive OR (X-OR) of the bits in the digital field. The present invention provides a different algorithm to calculate a different unique number or error code from the same command bits. This different number indicates that a second command set is being used. This different error code or unique number thus allows a second command to be interpreted independently from the original command giving an entirely new set of numbers for the digital field, thereby doubling the capacity of the command set.

In one embodiment, the unique number or error code is calculated using the same method as the original, and is then inverted to give the second, new command set for the digital field. An inversion produces a number which is least likely to occur simply as a result of bit errors during the reception and calculation of the unique error number. The invention maintains error protection, although at only a very slightly degraded level, since if the error by coincidence was the inverted new code, it wouldn't be flagged as an error.

Another aspect of the invention is directed to using fill bits, such as the three extra bits used in the command transmission for Lionel Trains. These extra bits fill up the time in between command packets, with one of the extra bits being calculated to be a 1 or 0 to ensure that the command signal does not produce a DC offset. The present invention utilizes two of those bits to transmit additional data, thus multiplying by a factor of three the available number of commands and compensating for the reduction in error code possibilities stated earlier. The additional bit used to counter DC offset takes into account, under the present invention, the value of the two fill bits in determining whether DC offset is present that needs to be counteracted.

For further understanding of the nature and advantages of the invention, reference should be made to the following description taken in conjunction with the accompanying drawings.

DETAILED DESCRIPTION OF THE INVENTION

Example Control System

Figure 1:
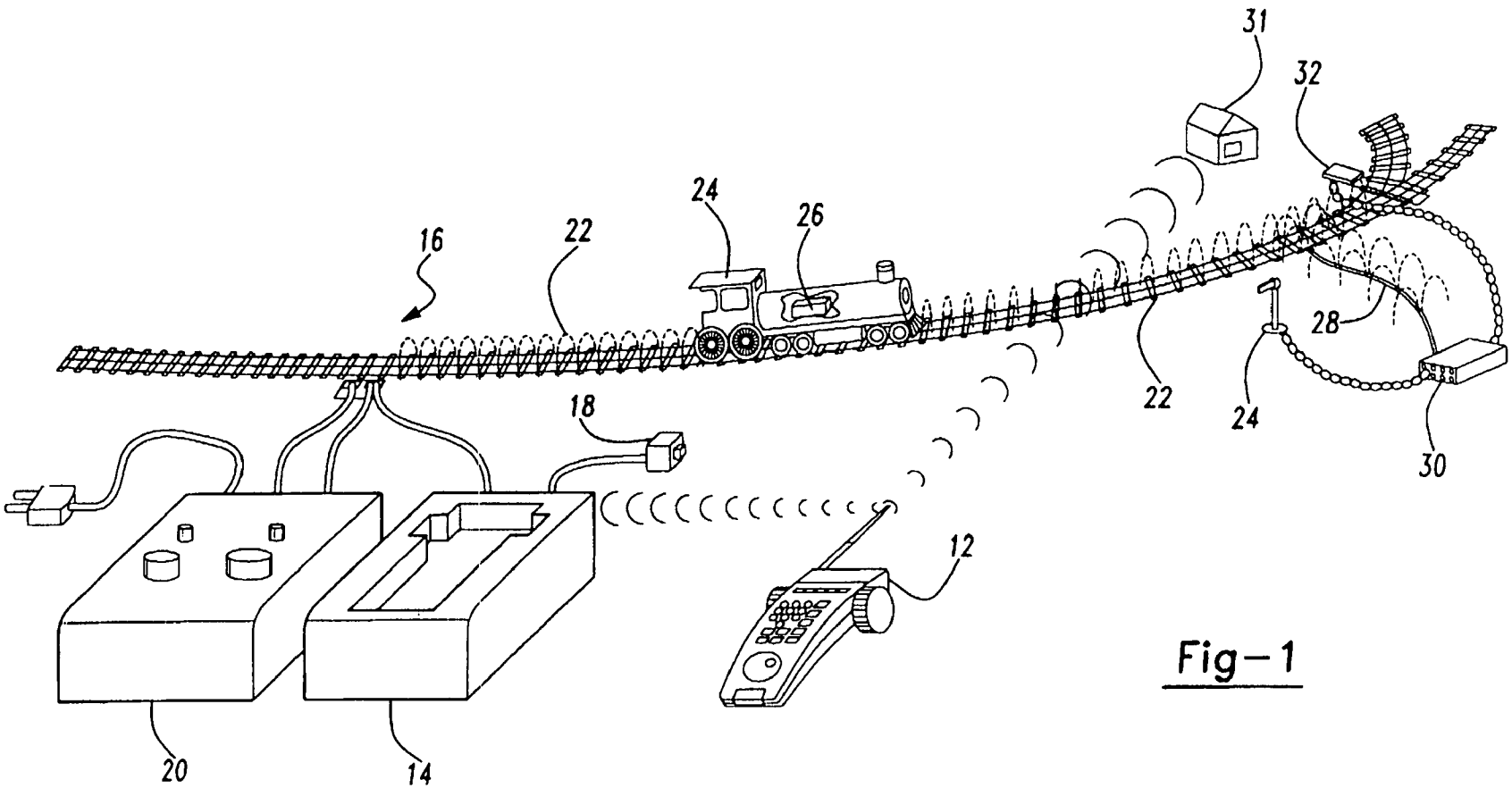
FIG. 1 is a diagram of an example of a model train system having commands transmitted to a train engine and accessories on the train layout.

FIG. 1 is a perspective drawing of an example layout of a train track system. A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

Base unit 14 transmits an RF signal between the track and earth ground, which generates an electromagnetic field indicated by lines 22 which propagates along the track. This field will pass through a locomotive 24 and will be received by a receiver 26 inside the locomotive an inch or two above the track. Locomotive 24 may be, e.g., a standard locomotive retrofitted or designed to carry a special receiver 26.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The use of both base unit 14 and power master unit 150 allows operation and control of several types of locomotives on a single track layout. Locomotives 24 which have been retrofitted or designed to carry receiver 26 are receptive to control signals delivered via base unit 14. Standard locomotives 24' which have not been retrofitted may be controlled using DC offset signals produced by power master unit 150.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks.

Train Circuitry

Figure 2:
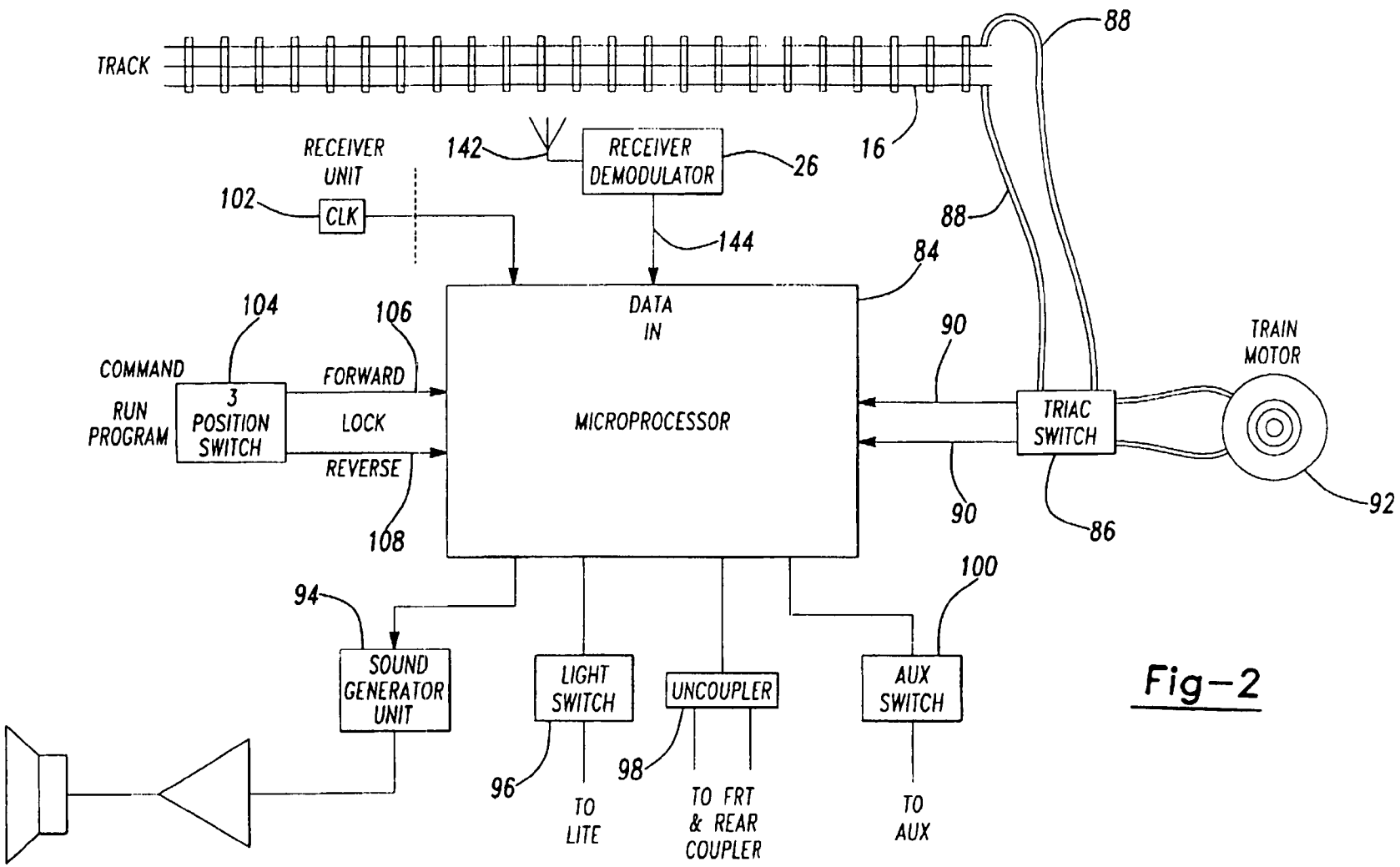
FIG. 2 is a diagram of an example of the circuitry inside a train engine for receiving such commands.

FIG. 2 is a block diagram of an example of the circuitry inside of a train 24 running on track 16. A receiver and demodulator circuit 26 picks up the electromagnetic field signals, and provides them to a data input of a microcontroller 84. The receiver can be an FM receiver chip and the microcontroller can be a microprocessor having a memory for storing instructions. The microprocessor controls a triac switching circuit 86. One side of the triac switches are connected to the train tracks through leads 88 which pick up power physically from the track. When activated by control signals from microcontroller 84 on lines 90, the triac switching circuit 86 will provide power to train motor 92, which moves the wheels of the train.

The microcontroller also has separate, dedicated output pins which can control a sound generator unit 94, a light switch 96, a coupler 98 and an auxiliary switch 100. The microcontroller is powered by an on-board clock 102.

A three position manual switch 104 is provided. In a first mode, the switch indicates on a line 106 that the train is to start in the forward direction. When in a second position, a signal on a line 108 indicates that the train is to start in the reverse direction. When the switch is in-between the two lines, in a "lock" mode, the microcontroller knows to start the train in the last direction it was in.

The same switch 104 can perform a second function. When a control command is received by the microcontroller, it knows to use the position of switch 104 to indicate either a "run" mode when the switch is in position 106, or a "program" mode when the switch is in the position on line 108.

In order to program an address into a train, the manual switch is moved into the program mode and the train is put on the track. The remote unit is then used to provide an address program command with a designated address for that train. This command is received by the receiver 26 and provided to microcontroller 84, which knows it should write into its memory that address as its designated address. Thereafter, in the run mode, the microcontroller will respond only to commands associated with that address.

New Command Set

Figure 3:
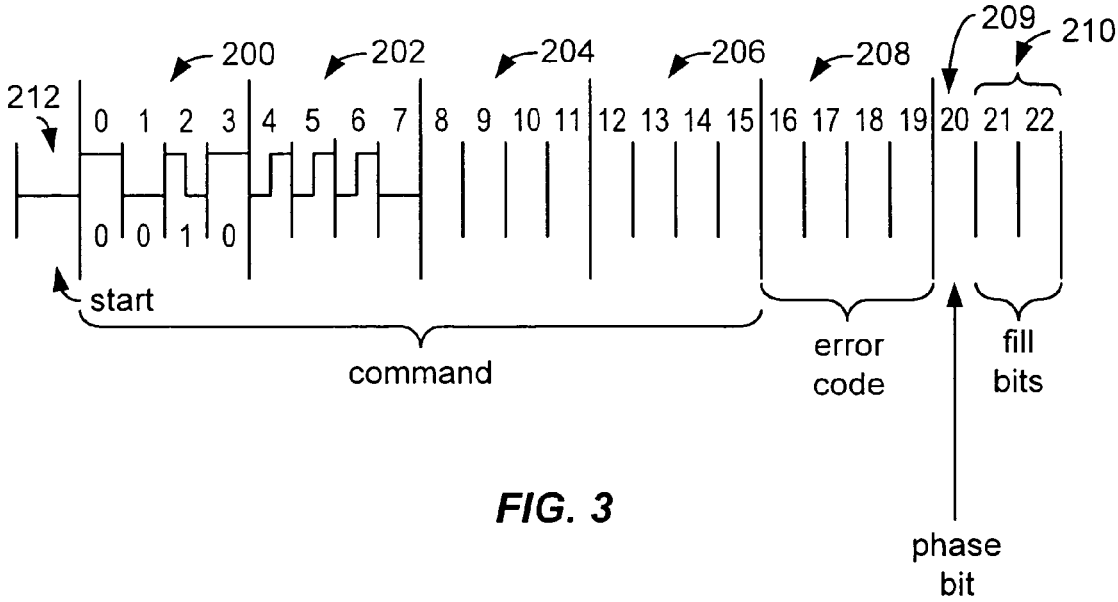
FIG. 3 is a diagram illustrating a command packet as modified by the present invention.

FIG. 3 is a diagram of a command packet illustrating an embodiment of the present invention. The command packet is the command packet used for the Lionel Train Master system. The packet contains four nibbles of data, nibbles 200, 202, 204 and 206. Each nibble contains four cells, with each cell storing a single bit. Also provided is a checksum, or error nibble 208. As noted in the Background, the error nibble is calculated by adding the values of nibbles 200, 202, 204 and 206. At the end of the packet are three trailer or filler bits, a phase bit 209 and two additional trailer bits 210. At the beginning of the packet is a start bit 212.

As can be seen, each of the command nibbles contains four cells, each with a bit of data. Looking at the first command byte 200, it is shown as encoding 0010. The 0 level is either high or low for the entire width of the cell. The protocol requires that the signal transition at each cell boundary. This transitioning helps ensure that the signal switches constantly to prevent a DC offset being imposed. As can be seen from the third cell in byte 200, a value of 1 is indicated by a transition in the middle of a cell. The start bit is distinguishable from the rest of the cells because it lasts one and one-half cell lengths at the same level, 0 level, thus indicating the new command packet is beginning.

Due to the clock timing used to generate the packet, there is a little extra time between command packets, which is filled by three filler or trailer bits 210. The last two bits are always a 1 in the existing Train Master protocol, while the bit in position or cell 20 is used for two purposes. The first is to offset any DC value generated by a particular combination of the command and error bytes by alternately setting cell 20 to a 0 or a 1 to compensate. The second function is to insure that the last transition bit time is smaller than 1 cell time. This insures proper start bit detection by the receivers.

The invention provides a method in which the command structure is expanded while maintaining full backwards compatibility. The solution is to send a command or message with a different method of calculating the error nibble in a manner other than what is currently being used, allowing unique identification of an old and new command structure. The ideal method is to create a pattern that is the exact opposite of the current method. This allows the current command set to be doubled and is fully compatible with all old receivers. The addition to the structure allows for an additional 65,536 commands for the Lionel Train Master protocol.

New receivers would make two checks. The first using the old method and in addition checking the bit 210 for a value of 11—if it passes, then it is considered an old command. If the bits of 210 are 00, 01 or 10 the error nibble is complemented and a second check is made. If the second check passes, it is considered the new style message and is identified uniquely as one of the three extended command sets. In the case presented there are 16 possible error combinations. In the old method 1 out of 16 is correct. With the new system 2 out of 16 would be correct. This reduces the error detection capability by half but the complemented selection is the best out of the 16 possible for the second choice. By using the addition bits contained in 210, the command and error detection is not reduced but rather enhanced because of the introduction and inclusion of these two bits in the command and error interpretation. This is not a concern due to the serial stream transmission format used where individual bit errors are the concern.

The following change is introduced to double the current command set structure without changing bits 210.

| | | | | | | |
|---|---|---|---|---|---|---|
| Old Method | | | | | | |
| 0000 | 0000 | 1001 | 1100 | 0101 | 1 11 | |
| 0 | 0 | 9 | C | 5 | Trailer 210 (always ones) | Engine 1 Horn |
| New Method | | | | | | |
| 0000 | 0000 | 1001 | 1100 | 1010 | 1 11 | |
| 0 | 0 | 9 | C | A | Trailer 210 (always ones) | New Command |

Second enhancement using trailer 210 bits to extend the command set and recover lost error code possibilities.

| | | | | | | |
|---|---|---|---|---|---|---|
| Old Method | | | | | | |
| 0000 | 0000 | 1001 | 1100 | 0101 | 1 11 | Trailer 210 (always ones) Engine 1 Horn |
| New Method | | | | | | |
| 0000 | 0000 | 1001 | 1100 | 1010 | 1 00 | Trailer 210 (00) New command set 0 bits 210 X-ORed with inverted error nibble |
| 0000 | 0000 | 1001 | 1100 | 1011 | 0 01 | Trailer 210 (01) New command set 1 bits 210 X-ORed with inverted error nibble |
| 0000 | 0000 | 1001 | 1100 | 1000 | 0 10 | Trailer 210 (10) New command set 2 bits 210 X-ORed with inverted error nibble |

The above embodiment is only one example of the applicability of the present invention. Any method that relies on two unique error values for selection by using or comparing the first value to the second value could be used. This can be done, for example, by performing a math function such as adding, subtracting, logical ORing, logical ANDing, logical X-ORing or comparing and regenerating a value to the original calculation to create a second unique number. The generation of a second unique number is based and computed on the information received.

Use of Trailer or Fill Bits

Figure 4:
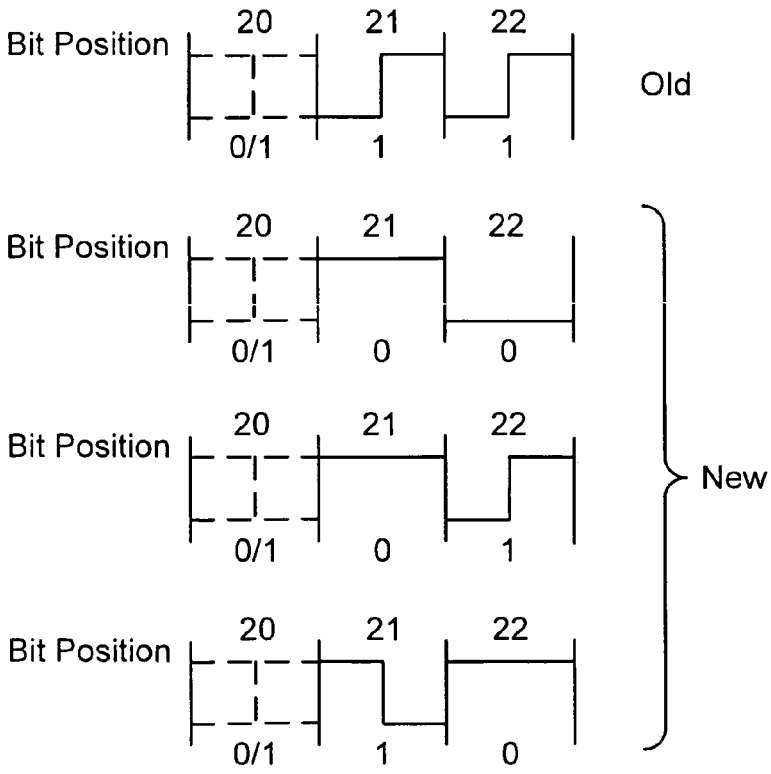
FIG. 4 is a diagram of alternate codings of the fill or trailer bits according to an embodiment of the invention.

Another aspect of the present invention utilizes the last three bit positions shown in FIG. 3 to extend the command set. As shown in FIG. 4, the old method in the Lionel protocol uses bits 21 and 22 to indicate a 1, with transitions in the middle of the cell. This fills up the space between command packets. Bit position 20 can be either a 0 or a 1, as needed to balance a command to provide either more positive or negative value to ensure that there is no DC offset.

The present invention adds three new combinations as illustrated, with the last two bits being either 00, 01 or 10. This means in the Lionel implementation that three additional sets of 65,536 commands will be added to the existing structure. These combinations can be used to separately expand the command set, using only the old error nibble, or could be combined with use of the new error nibble. Using these two bits creates additional bits to include in the calculation of the error nibble. The best way to calculate the new error nibble would be to use only the combinations that would provide the greatest differences in bit pattern from the original error nibble. The most preferred method would be to X-OR the two bits of the trailer with the error nibble, removing any combination that would have a difference less than three bits (the combination of 11 is not used in the X-ORed calculation; only 00, 01 and 10). Reserving this 11 combination provides an additional check between the old and new command set structure. X-ORing holds bit places and is preferred because it insures at least three bit differences between the original and new error nibble calculation. This along with reserving the 11 trailer bit combinations provides a method that can further distinguish between an error nibble in the old and new methods.

Bit position 20 is a phase bit used to control the ending waveform to insure the last cell width is less than one cell time and provides the best neutralization of the DC offset.

The old system had only one check on the receiver data, the checksum. The new protocol and receivers add additional checks on the old data method along with new checks described below.

Existing Check 4 bit checksum type based in bit positions <16 19>

New Checks for Old TMCC

Phase Bit Check bit position <20>

Ending 11 check in bit positions <21 22>

4 bit checksum type based in bit positions <16-19>

Additional checks in extended protocol

Phase bit check of entire message including bit positions 21 and 22

Ending check of 00, 01 or 10 in positions <21 22>

Uses inverted checksum calculation in combination with bits 21 and 22 that are exclusive-ORed into the error calculation as described previously Repetition algorithm based on receiving two identical valid commands within 100 ms Phase bit check of entire message Transmission method of sending each command 9 times total, 3 bursts of 3 commands The new check of bit position 20 for old TMCC commands will be an additional way to detect an error, with the error either being in the command or the phase bit itself. This is done by the receiver of the command re-doing the calculation of what the phase bit should be to provide the desired DC offset compensation, and then determining if that is in fact its value received. An error in the phase bit could be a problem with the calculation on the transmission side, or interference in the transmission corrupting the phase bit, or the command therefore the phase bit 209 is calculated after the data and trailer results have been calculated. The phase bit 209 is then adjusted to the proper value as previously described.

The new checksum calculation will include the two fill bits, 21 and 22, by exclusive-ORing them into the check sum. The algorithm for the new checksum, in a preferred embodiment, is (1) adding the values of the four nibbles, (2) dropping the most significant bit, (3) inverting the resulting number, and (4) exclusive-ORing with bits 21 and 22 in bit positions <1 and 0> of the error nibble. Alternately, other algorithms could be used, such as exclusive-ORing or some other combination before or after the inversions, or some operation other than an inversion. Or, an entirely different algorithm could calculate a unique number directly from the command and fill bits.

Although one embodiment has been described above, the present invention can embodied in other specific ways without departing from the essential characteristics of the invention. For example, the error nibble could simply be a number calculated from the preceding digital field. Although a command with four nibbles of four bits each has been shown, other command sizes could be used. Also, different sizes of the unique number or error nibble could be used, such as 2, 3, 4, 6, 8, or any other number of bits. The error number could be a checksum, CRC, or any other error code, such as a Reed Solomon code, or some other code not used for error detection. The commands or other digital data could be provided for any type of system, not just model trains. The data need not be command, but could be simply messages or other digital data. Accordingly, the foregoing description is intended to be illustrative, but not limiting, of the scope of the invention which is set forth in the following claims.

What is claimed is:

1. A method for expanding the capacity of a fixed digital field for a model train control system, comprising:

providing a unique number field for a unique number calculated from the bits in said digital field;

calculating a first unique number from said digital field according to a first algorithm;

determining if said first unique number is present in said unique number field;

assigning a first meaning to a particular combination of bits in said digital field if said first unique number is present;

if said first unique number is not present, calculating a second unique number according to a second algorithm;

determining if said second unique number is present in said unique number field; and assigning a second meaning to said particular combination of bits in said digital field if said second unique number is present.

2. The method of claim 1 further comprising:

indicating an error if neither said first nor said second unique number is present.

3. The method of claim 1 wherein said particular combination of bits is a command.

4. The method of claim 3 wherein said command is for an operation in a model train.

5. The method of claim 4 wherein said command further includes an address of said model train.

6. The method of claim 1 wherein said first unique number is a multiple bit code.

7. The method of claim 6 wherein said second unique number is the inverse of said first unique number.

8. The method of claim 1 wherein said unique number is an error code.

9. The method of claim 1 wherein said fixed digital field is part of a transmission packet.

10. The method of claim 1 wherein fill bits are used in transmission of said fixed digital field, and further comprising:

detecting said fill bits;

determining if said fill bits have a value other than a designated fill value;

if said fill bits have a value other than said designated fill value, assigning a different meaning to the combination of bits in said fixed digital field based on the value of said fill bits.

11. The method of claim 10 further comprising:

modifying a value of one of said fill bits, in accordance with the values of remaining ones of said fill bits, to minimize a DC offset of said transmission packet and fill bits.

12. The method of claim 10 further comprising:

utilizing at least one of said fill bits in calculating said second unique number.

13. The method of claim 10 wherein said first unique number is a multiple bit code and said second unique number is the inverse of said first unique number.

14. A method for expanding the capacity of a fixed digital command field for a model train control system, comprising:

providing a multiple bit error code field for a unique number calculated from the command bits in said digital field;

calculating a first multiple bit error code from said digital field according to a first algorithm;

determining if said first multiple bit error code is present in said unique number field;

assigning a first meaning to a particular combination of bits in said digital field if said first multiple bit error code is present;

if said first multiple bit error code is not present, calculating a second multiple bit error code according to a second algorithm;

determining if said second multiple bit error code is present in said multiple bit error code field;

assigning a second meaning to said particular combination of bits in said digital field if said second multiple bit error code is present; and indicating an error if neither said first nor said second multiple bit error code is present.

15. A method for expanding the capacity of a fixed digital command field for a model train control system, wherein the command field comprises four nibbles of four bits each, comprising:

providing a multiple bit checksum field for a unique number calculated from the command bits in said digital field;

calculating a first checksum from said command field by summing the values of each of said nibbles and dropping the most significant bit of the result;

determining if said first checksum is present in said unique number field;

assigning a first meaning to a particular combination of bits in said command field if said first checksum is present;

if said first checksum is not present, calculating a second multiple bit error code according to a second algorithm;

determining if said second multiple bit error code is present in said multiple bit error code field; and assigning a second meaning to said particular combination of bits in said command field if said second multiple bit error code is present; and indicating an error if neither said first nor said second multiple bit error code is present.

16. An apparatus in a model train control system for receiving a digital field, comprising:

a memory storing first and second algorithms;

a processor, coupled to said memory;

a program embodied in computer readable code in said memory, containing instructions configured to detect a unique number field for a unique number calculated from the bits in said digital field;

calculate a first unique number from said digital field according to said first algorithm;

determine if said first unique number is present in said unique number field;

assign a first meaning to a particular combination of bits in said digital field if said first unique number is present;

if said first unique number is not present, calculate a second unique number according to a second algorithm;

determine if said second unique number is present in said unique number field; and assign a second meaning to said particular combination of bits in said digital field if said second unique number is present.

17. The apparatus of claim 16 wherein said processor is a hardware FPGA.

* * * * *